US005455733A

United States Patent [19]

Waggamon

[11] Patent Number: 5,455,733

[45] Date of Patent: Oct. 3, 1995

[54] CONTACT STATUS MONITOR

[75] Inventor: Dennis W. Waggamon, North Canton, Ohio

[73] Assignee: GMI Holdings, Inc., Del.

[21] Appl. No.: 267,008

[22] Filed: Jun. 27, 1994

Related U.S. Application Data

[63] Continuation of Ser. No. 896,440, Jun. 10, 1992, abandoned.

[51] Int. Cl.[6] ..... H01H 73/12

[52] U.S. Cl. ..... 361/115; 340/638; 340/644; 324/415; 307/132 E

[58] Field of Search ..... 361/88, 115, 160, 361/170, 187; 340/638, 644; 323/902; 324/415; 307/116, 125, 130, 132 E, 129

[56] References Cited

U.S. PATENT DOCUMENTS

| | | | |
|---|---|---|---|
| 3,775,573 | 11/1973 | Gaon | 179/175.23 |
| 4,340,852 | 7/1982 | Togneri | 340/644 |
| 4,634,842 | 1/1987 | Payne | 219/486 |
| 4,710,645 | 12/1987 | Doittau et al. | 307/132 E |
| 4,713,716 | 12/1987 | Takemura et al. | 361/2 |
| 4,757,417 | 7/1988 | Futsuhara | 361/88 |
| 4,777,479 | 10/1988 | Hinckley | 340/644 |
| 4,914,315 | 4/1990 | Nickolai | 307/137 |
| 4,977,478 | 12/1990 | Powell | 361/160 |
| 5,031,110 | 7/1991 | Yocom | 364/481 |
| 5,134,375 | 7/1992 | Fuchi | 324/415 |

FOREIGN PATENT DOCUMENTS

| | | |
|---|---|---|
| 0050417 | 9/1981 | European Pat. Off. . |
| 0294794A2 | 12/1988 | European Pat. Off. . |
| 2135798 | 12/1983 | United Kingdom . |

*Primary Examiner*—A. D. Pellinen
*Assistant Examiner*—Ronald W. Leja
*Attorney, Agent, or Firm*—Rankin, Hill, Lewis & Clark

[57] ABSTRACT

A circuit which gives a continuous voltage output indication of whether a contact is open or closed. The circuit senses the voltage across the contact to detect whether the contact is open or closed. When there is a significant voltage, the circuit indicates that the contact is open. When the voltage is negligible, the circuit indicates that the contact is closed. Alternatively, the current through the contact can be sensed to provide an indication of whether the contact is conducting or not. The circuit can be used to indicate the welding close of a relay contact in which case power to the load can be turned off or the contact can be opened by other than normal corrective actions. One application is to discontinue closing movement of a garage door when the motor relay switch does not open as desired, but there are innumerable other applications.

6 Claims, 3 Drawing Sheets

Y
X
Vxy
Vxz
LOAD
10
11
12
13
26
18
20
16
17
V1
OPTO ISOLATOR
15
19
21
22
23
V2
V2
CONTROL CIRCUIT
14

LOAD
OPTO ISOLATOR
CONTROL CIRCUIT
Y
X
Vxy
Vxz
V2
V1
V1
10
11
12
13
14
15
16
17
18
19
20
21
22
23
25
26

CONTACT STATUS MONITOR

This is a continuation of application Ser. No. 07/896,440, filed on Jun. 10, 1992, now abandoned.

BACKGROUND OF THE INVENTION

1. Field of the Invention

This invention relates generally to a switch status monitor and specifically to a circuit which detects a welded motor controller relay contact in a garage door opener. The monitoring circuit provides a contact status signal to the garage door controller so that corrective action can be taken if the relay contact is welded closed.

2. Description of the Prior Art

In electrical circuits, it is often desirable to have a positive indication of the status of switch contacts to ensure that the contacts are in the proper position. This is particularly desirable in circuits employing relays which are often used to switch load current circuits. These high currents sometimes cause the relay contacts to stick together. The contacts are welded together by the electric arc occurring during switching. Other electrically operated switching devices such as triacs can also fail in a conducting state. If a switching device remains in a conducting state when it should not be conducting, damage to the load may occur or the continued, unwanted operation of the load may cause injury or damage.

In a system which opens and closes a garage door, relay contacts are often used to control a motor which moves the door. Welded contacts in a motor control circuit can cause the motor to continue operating when it should be stopped. For example, the door may continue closing after an operator has commanded the door to stop. Also, a safety system which detects obstructions to garage door closing could be rendered inoperative if a welded contact causes continued closing of the garage door after the safety system has detected an obstruction and commanded the motor to stop.

A number of schemes for monitoring contact status have been developed. Many use auxiliary contacts on the relay, however these do not permit direct monitoring of the main contact.

Other means use various forms of current detection. One such means disclosed in U.S. Pat. No. 4,914,315 to Nickolai compares the load signal to the relay coil signal. If they do not match, the circuit pulses the relay coil. Nickolai does not disclose the means of signal comparison.

Another means disclosed in U.S. Pat. No. 3,775,573 to Gaon sends a pulse through the contact which is detected if the contact is closed. U.S. Pat. No. 4,977,478 to Powell provides reference voltages on either side of the contact. Through resistors, these reference voltages provide a signal at a common junction which is compared to other reference voltages to determine contact status. These devices have the disadvantage that a reference signal must be supplied to the contacts and isolated from the signal which the contact is intended to switch. The switched signal must be of a kind which will not influence the detection circuit.

No device for monitoring the status of a garage door opener motor control contact is known to have been disclosed.

SUMMARY OF THE INVENTION

The present invention provides a switch monitor circuit for determining the status of an object switch in a circuit. The monitor circuit includes a monitor signal terminal the potential of which provides an indication of whether the object switch is conducting or not conducting. An electrically operated monitor switch has its input in communication with a circuit including the object switch and its output connected between the monitor signal terminal and a first reference potential. A monitor resistance is connected in series with the input of the monitor switch and a control resistance is connected between the monitor signal terminal and a second reference potential.

This simple device monitors the status of a load control contact by measuring the voltage across the contact or the current through the contact without introducing a signal into the load circuit. Typically, the contact and load are connected in series between power supply lines. The motor can be controlled by a switch such as a triac or SCR rather than a contact. Preferably, the monitor circuit includes an opto-isolator having its light emitting diode part connected in parallel across the contact. Current limiting resistors are connected in series with the opto-isolator and a diode can be connected across the opto-isolator with its polarity opposite that of the LED. The diode protects the opto-isolator from an avalanche current when the line supplies alternating current.

The phototransistor part of the opto-isolator has a control voltage supplied to its collector through a pull-up resistor and its emitter is grounded or connected to some other reference potential. A capacitor can be connected between the phototransistor collector and ground to smooth out current.

If the voltage sensing circuit is connected in parallel across the contact, when the contact is closed, virtually no current flows through the input of the opto-isolator, and therefore, the phototransistor is in its nonconducting state and no current flows through the output of the opto-isolator. The potential of the collector of the phototransistor, and thus the monitor signal terminal, is pulled towards the control voltage. When the contact is open, a current flows through the opto-isolator input, thus, the phototransistor is in its conducting state and its collector potential is near ground. Therefore, the monitor signal potential is also near ground.

If the sensing circuit is connected in series with the contact or across a resistor which is in series with the contact, the operation is reversed from that described above. That is, when the contact is closed, the monitor signal potential is near ground. When the contact is open, the monitor signal potential is pulled towards the control voltage.

The opto-isolator output signal provides an indication of the contact status which can be used, for example, to initiate corrective action by a control circuit when the contact is not in its desired position. In a garage door opener, the contact which controls motor operation can become welded closed. In that case, the door continues to close after the control circuit has commanded it to stop. The present invention signals the control circuit that the contact is still closed so that power to the motor can be disconnected.

DESCRIPTION OF THE PREFERRED EMBODIMENTS

Figure 1:
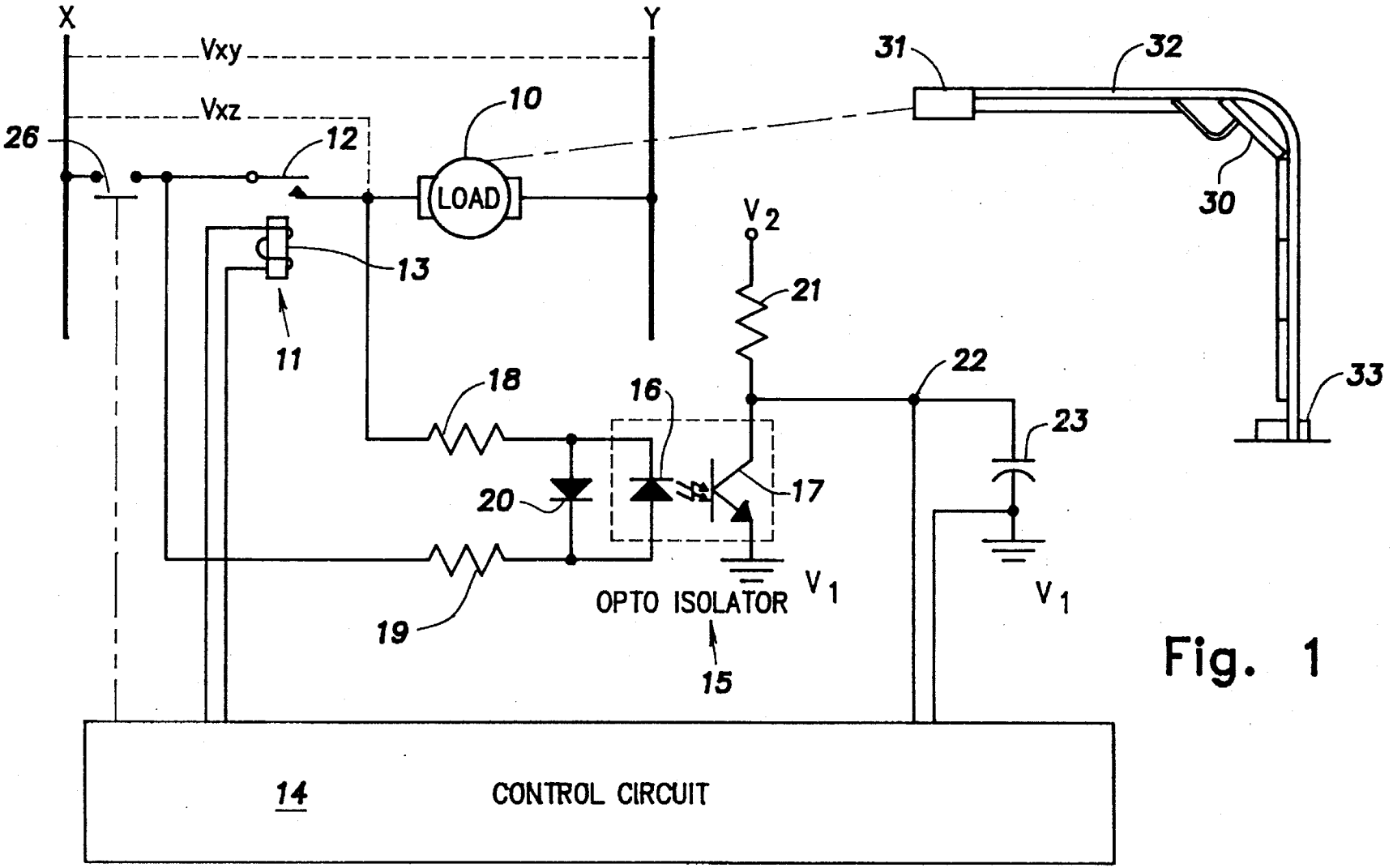
FIG. 1 is a schematic view of a voltage sensing monitor circuit connected to a garage door and opener.

A load 10 is shown in FIG. 1. In the preferred embodiment the load 10 is a garage door opener motor, but the present invention can be applied to many electrical loads. The load 10 is supplied by lines X and Y with power Vxy which is typically a standard household supply such as 120 volts, 60 hertz. Power to the load is controlled by an object switch which is normally a relay 11 having a coil 13 and a contact 12 in series with the load 10. A voltage across the contact 12 is identified as Vxz. The load can also be controlled by another type of electrically operated object switch such as a triac or SCR. Rather than being "open" or "closed" as discussed below, such solid state switches are "nonconducting" or "conducting."

When the coil 13 is not energized by a control circuit 14, the contact 12 is open. The load 10 is thereby disconnected from the power supply Vxy and the voltage Vxz across the contact is near Vxy.

When the coil 13 is energized by the control circuit 14, the contact 12 is closed. The voltage across the load 10 is vxy and the load is operative; the voltage Vxz across the contact is near zero.

The monitoring system is connected in parallel across the relay contact 12 as shown in FIG. 1 and described below. An electrically operated monitor switch 15 has its input connected in parallel across the contact 12. Preferably, the monitor switch 15 is an opto-isolator having at least one light emitting diode (LED) 16 on its input side and a phototransistor 17 on its output side. Any electrically operated switching device such as a relay or transistor can be used for the switch 15. However, it is preferred that the output side be isolated from the input side for safety and to protect the control circuit 14 components.

Two monitor resistances 18 and 19 are connected in series with the input 16 of the switch 15. The two resistors 18 and 19 are preferred to protect the switch input 16 from positive and negative transient voltages. The resistance shown comprises two 33 kΩ, ½ watt resistors for a 120 volts supply power Vxy. However, the resistance may be varied to be compatible with the supply power Vxy, the type of load 10 and the type of switching device 15. When the contact 12 is closed, the monitor resistors 18 and 19 provide a high resistance path compared to the contact 12 so that virtually no current flows through the monitor resistors 18 and 19 and the switch input 16. The current should be low enough that it does not operate the switch 15. When the switch is an opto-isolator, the current should not cause the phototransistor 17 to be in its conducting state.

When the contact 12 is open, the voltage Vxz across the contact causes a current to flow through the resistors 18 and 19 and the switch input 16. This current should be high enough to operate the switching device 15. When the switch is an opto-isolator, the current should be high enough to place the phototransistor 17 in its conducting state. Preferably, an AC input opto-isolator should be used with a noise suppressing capacitor 27 (≈0.01 μf) connected in parallel across the opto-isolator input. The AC opto-isolator has two LEDs 16*a* and 16*b* connected in parallel with opposite polarity.

Figure 1A:
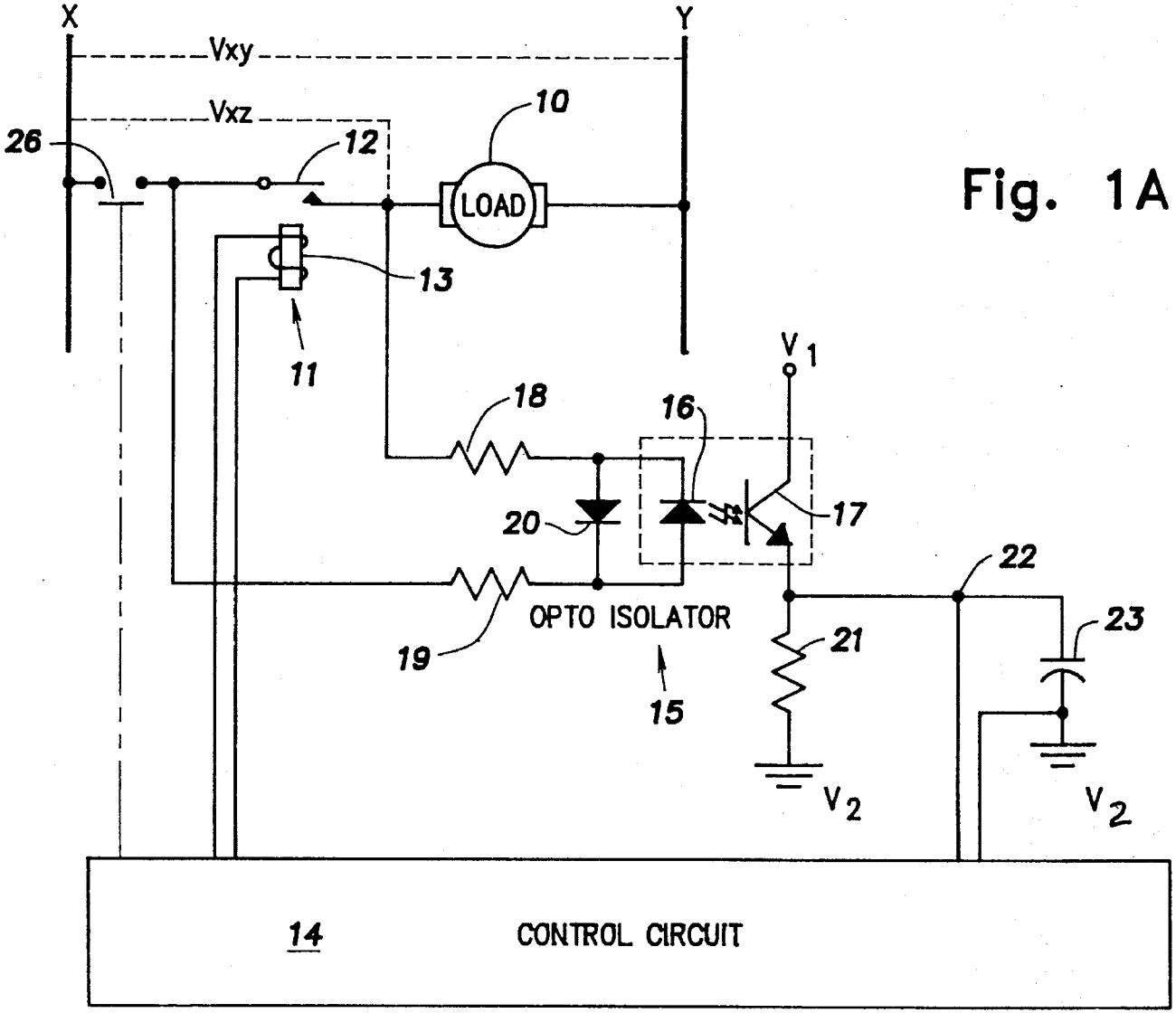
FIG. 1A is a schematic view of a voltage sensing monitor circuit having a modified output configuration.

If the power supply Vxy is DC, the polarity of the LED 16, shown in FIG. 1A, should be such that it will conduct when the contact 12 is open, that is, the LED 16 should be forward biased. If the power supply Vxy is AC and a DC opto-isolator is used, a diode 20 can be connected in parallel across the LED 16. The diode 20 should be connected with its polarity opposite that of the LED 16 so that the diode 20 is forward biased or conducting when the LED 16 is reverse biased or nonconducting. This diode 20 protects the LED 16 from an avalanche current from the AC power supply.

The output 17 of the switch 15 is connected between first and second reference potentials V1 and V2. In FIG. 1, the first reference potential V1 is ground and the second reference potential V2 is a control voltage. The control voltage V2 is supplied through a control resistance 21 which is preferably a 33 kΩ resistor. In the embodiment shown, the control voltage V2 is supplied through the resistor 21 to the collector of the phototransistor 17. The emitter of the phototransistor 17 is connected to ground V1.

The connection between the control resistance 21 and the switch output 17 is a monitor signal terminal 22. The device which uses the output signal should be connected to the monitor signal terminal 22 and to ground V1 as a reference. In the embodiment shown, the control circuit 14 is connected to the monitor signal terminal 22 and ground V1.

When the contact 12 is closed, the switch output 17 is in its non-conducting state. The monitor signal terminal 22 is isolated from ground and its potential is pulled towards the control voltage V2. This potential at the monitor signal terminal 22 indicates that the contact 12 is closed. When the power supply Vxy is AC, the signal at the switch output 17 is pulsating DC. A capacitor 23 should be connected in parallel across the switch output 17 to smooth out the signal and maintain a potential at the monitor signal terminal 22 which is sufficient to indicate that the contact 12 is closed. If the contact 12 is supposed to be open, but is closed because it is welded or for some other reason, the control circuit 14 can take the necessary corrective action. The power supply to the load can be disconnected by means other than the relay 11, for example, a safety switch 26 in series with the load 10 can be opened by the control circuit 14. Alternatively the control circuit 14 can attempt to open the contact 12 again, for example, by applying an AC voltage or a pulsating DC voltage to the relay coil 13.

When the contact 12 is open, the voltage Vxz across the contact is pulled towards Vxy. A current flows through the switch input 16 which causes the switch output 17 to be in its conducting state. The potential at the monitor signal terminal 22 is pulled towards ground V1 which indicates that the contact 12 is open.

FIG. 1A shows an alternative configuration for the output side of the monitor circuit. The control resistor 21 is connected between the monitor signal terminal 22 and the second reference potential V2 which, in this case, is ground. The switch output 17 is connected between the monitor signal terminal 22 and the first reference potential V1 which, in this case, is the control voltage. All other elements are connected identically as shown in FIG. 1 discussed above or can be connected as in FIG. 2 discussed below.

The potential at the monitor signal terminal 22 indicates whether the object switch 12 is conducting or non-conducting. When the object switch is not conducting, a current flows through the switch input 16 and the switch output 17 is in its conducting state so that the potential at the monitor signal terminal 22 is near first reference potential V1. When the object switch 12 is conducting, a negligible current flows through the switch input 16 and the switch output 17 is in its non-conducting state so that the potential at the monitor signal terminal 22 is pulled towards the second reference potential V2.

Figure 2:
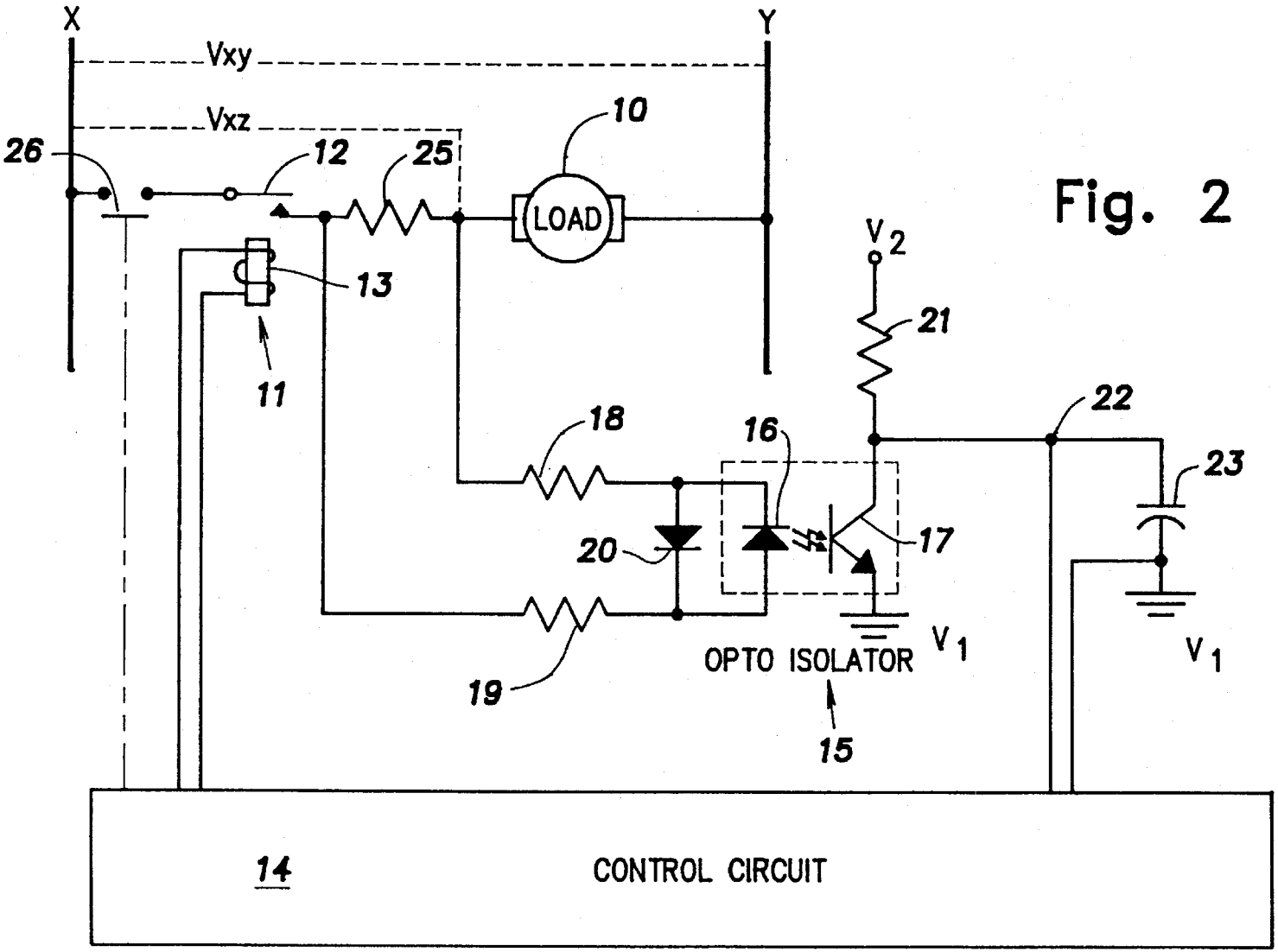
FIG. 2 is a schematic view of a current sensing monitor circuit.

FIG. 2 shows an alternative monitor circuit which is identical to the circuit of FIG. 1 in all respects except that a circuit resistance 25 is connected in series with the contact 12 and the input of the monitor circuit is connected in parallel across the resistance 25. When the contact 12 is open, no current flows through the switch input 16. The switch output 17 is in its non-conducting state so that the potential at the monitor signal terminal 22 is pulled towards V2. When the contact 12 is closed, most of the current through the contact 12 flows through the resistance 25 and some of the current flows through the switch input 16. The current through the switch input 16 is sufficient to cause the switch output 17 to conduct so that the voltage at the monitor signal terminal 22 is pulled towards V1. Thus, the potential at the monitor signal terminal 22 in the FIG. 2 embodiment is opposite of the potential in the FIG. 1 embodiment for the same contact status.

This invention can be applied, for example, to a garage door opener safety circuit as shown in FIG. 1. In such a circuit, the load 10 is a motor in a garage door opener 31 and the relay 11 controls the motor. The relay 11 is operated by a control circuit 14. The relay contact 12 closes to energize the motor to open or close a door 30 which runs on a track 32. If the relay contact 12 is welded closed, the door 30 will continue to open or close when it should be stopped. If the relay contact 12 is welded closed when the door 30 is closing, the closing door will not be stopped by signals which usually cause the relay 11 to open. The present invention can provide a signal through the monitor signal terminal 22 to the control circuit 14 of the garage door opener which will indicate that the contact 12 is closed. If the contact 12 is supposed to be open, the control circuit 14 can take corrective action to stop the door from closing. For example, the control circuit 14 can open a safety switch 26 to disconnect power from the motor load 10 to stop the door 30 from closing.

The present disclosure describes several embodiments of the invention, however, the invention is not limited to these embodiments. Other variations are contemplated to be within the spirit and scope of the invention and appended claims.

What I claim is:

1. A switch monitor circuit for determining the status of a coil actuated relay object switch used to connect power to a garage door opener motor, comprising:

a control circuit that operates the object switch;

a monitor signal terminal directly connected as an input to the control circuit;

a circuit resistance connected in series with the object switch and the motor, the circuit resistance conducting motor current when the object switch is closed;

an electrically operated opto-isolator monitor switch having as its input a light emitting diode connected in parallel across the circuit resistance and as its output a phototransistor directly connected between the monitor signal terminal and a first reference potential, there further being a capacitor connected between the monitor signal terminal and said first reference potential;

a monitor resistance connected in series between the input of the monitor switch and said circuit resistance, the monitor resistance comprising a first resistance connected directly in series between an anode of the light emitting diode and one side of said circuit resistance, and a second resistance connected directly in series between a cathode of the light emitting diode and an opposite side of said circuit resistance, so that when the object switch is not conducting, a negligible current flows through the monitor switch input such that no current flows through the monitor switch output, and when the object switch is conducting motor current, voltage across said circuit resistance causes a current flow through the monitor switch light emitting diode which permits current to flow through the monitor switch phototransistor output; and a control resistance connected between the monitor signal terminal and a second reference potential so that when no current is flowing through the monitor switch output, the monitor signal terminal potential is pulled towards the second reference potential, and when a current is flowing through the monitor switch output, the monitor signal terminal potential is pulled towards the first reference potential; said control circuit being connected to one of said reference potentials.

2. A switch monitor circuit for determining the status of a coil actuated relay object switch used to connect supply voltage to a garage door opener motor, comprising:

a control circuit that operates the object switch;

a monitor signal terminal directly connected as an input to the control circuit;

an electrically operated opto-isolator monitor switch having as its input a light emitting diode connected in parallel across the object switch contacts and as its output a phototransistor directly connected between the monitor signal terminal and a first reference potential, there further being a capacitor connected between the monitor signal terminal and said first reference potential;

a monitor resistance connected directly in series between the input of the monitor switch and the object switch, the monitor resistance comprising a first resistance connected directly in series between an anode of the light emitting diode and a first contact of the object switch, and a second resistance connected directly in series between a cathode of the light emitting diode and a second contact of the object switch, so that when the object switch is conducting motor current, a negligible current flows through the monitor switch input such that no current flows through the monitor switch output, and when the object switch is not conducting, a current produced by the supply voltage and said monitor resistance flows through the monitor switch light emitting diode which permits current to flow through the monitor switch output; and a control resistance connected between the monitor signal terminal and a second reference potential so that when no current is flowing through the monitor switch output, the monitor signal terminal potential is pulled towards the second reference potential, and when a current is flowing through the monitor switch output, the monitor signal terminal potential is pulled towards the first reference potential; said control circuit being connected to one of said reference potentials.

3. A monitor circuit according to claim 2, wherein the control circuit includes a second switch for disconnecting the object switch from its circuit if a voltage indicates the object switch is closed when it should be open.

4. A monitor circuit according to claim 2, further comprising a monitor capacitor in parallel across the input of the electrically operated monitor switch.

5. A monitor circuit according to claim 2, wherein the opto-isolator is adapted for alternating current input.

6. A monitor circuit according to claim 2, wherein the opto-isolator input is a pair of light emitting diodes connected in parallel with opposite polarity and the output is a phototransistor.

* * * * *